US010849405B2

(12) United States Patent
Roh

(10) Patent No.: US 10,849,405 B2
(45) Date of Patent: Dec. 1, 2020

(54) CAP AND VIAL APPLICATOR SYSTEM FOR APPLYING TWO COSMETIC PRODUCTS

(71) Applicant: ELC MANAGEMENT LLC, Melville, NY (US)

(72) Inventor: Yeon Jung Roh, Astoria, NY (US)

(73) Assignee: ELC Management LLC, Melville, NY (US)

( * ) Notice: Subject to any disclaimer, the term of this patent is extended or adjusted under 35 U.S.C. 154(b) by 0 days.

(21) Appl. No.: 15/710,044

(22) Filed: Sep. 20, 2017

(65) Prior Publication Data

US 2019/0082810 A1 Mar. 21, 2019

(51) Int. Cl.

| | |
|---|---|
| ***A45D 40/24*** | (2006.01) |
| ***A45D 34/04*** | (2006.01) |
| ***A45D 34/00*** | (2006.01) |

(52) U.S. Cl.

CPC ..... *A45D 40/24* (2013.01); *A45D 34/045* (2013.01); *A45D 34/046* (2013.01); *A45D 2034/005* (2013.01)

(58) Field of Classification Search

CPC .... A45D 40/24; A45D 34/046; A45D 34/045; A45D 2200/055; A45D 2034/005

USPC ..... 401/17, 23, 24, 25, 26

See application file for complete search history.

(56) References Cited

U.S. PATENT DOCUMENTS

| | | | | |
|---|---|---|---|---|
| 4,617,948 | A | 10/1986 | Gueret | |
| 5,002,415 | A | 3/1991 | Gueret | |
| 5,096,319 | A | 3/1992 | Gueret | |
| 5,339,841 | A | 8/1994 | Gueret | |
| 5,346,324 | A * | 9/1994 | Kuo | A46B 11/0055 401/146 |
| 7,118,298 | B2 | 10/2006 | Tsutsumi | |
| 7,261,483 | B2 | 8/2007 | Gueret | |
| D554,803 | S | 11/2007 | Parker | |

(Continued)

FOREIGN PATENT DOCUMENTS

| | | |
|---|---|---|
| EM | 000024831-0001 | 11/2003 |
| EM | 001072136-0001 | 2/2009 |

(Continued)

OTHER PUBLICATIONS

PCT International Search Report; International Application No. PCT/US2018/051102; Completion Date: Jan. 10, 2019; dated Jan. 10, 2019.

(Continued)

*Primary Examiner* — David J Walczak

(74) *Attorney, Agent, or Firm* — Martin Haerter; Peter Giancana

(57) ABSTRACT

An applicator package is provided that has a vial, a cap and a rod with an applicator tip extending from the cap into the vial. The vial contains a cosmetic first substance and the cap contains a cosmetic second substance in a cartridge. The cosmetic first substance is dispensed from the vial by dipping the applicator into the substance in the vial. The second substance is dispensed from the cartridge by depressing the cartridge into the cap to activate a pump that dispenses the second substance through a dispensing port onto a surface of the applicator tip. The first and second substances may be applied individually in stages, or the substances may be applied simultaneously after loading each on the applicator.

4 Claims, 3 Drawing Sheets

(56) References Cited

U.S. PATENT DOCUMENTS

| | | | | |
|---|---|---|---|---|
| 7,467,906 | B2 * | 12/2008 | Gueret | A45D 34/042 401/119 |
| 7,503,718 | B2 | 3/2009 | Hamada | |
| 7,534,062 | B2 | 5/2009 | Ramet | |
| D614,347 | S | 4/2010 | Uehara et al. | |
| D617,045 | S | 6/2010 | Uehara et al. | |
| 7,841,794 | B2 | 11/2010 | Salciarini et al. | |
| D628,741 | S | 12/2010 | Uehara et al. | |
| D633,650 | S | 3/2011 | Uehara et al. | |
| 7,980,778 | B2 | 7/2011 | Akaishi et al. | |
| D668,541 | S | 10/2012 | McCoy et al. | |
| 8,353,636 | B2 | 1/2013 | Drugeon et al. | |
| D680,265 | S | 4/2013 | DeMarco et al. | |
| D685,948 | S | 7/2013 | Pires et al. | |
| 8,540,447 | B2 * | 9/2013 | Bauer | A45D 34/046 401/122 |
| 8,777,506 | B2 | 7/2014 | Akaishi et al. | |
| 8,783,988 | B2 | 7/2014 | Sanchez | |
| D739,084 | S | 9/2015 | Hall | |
| D742,588 | S | 11/2015 | Cutler | |
| 9,215,922 | B2 | 12/2015 | Delage et al. | |
| 9,398,800 | B2 | 7/2016 | Uehara et al. | |
| 9,468,280 | B2 | 10/2016 | Uehara et al. | |
| D786,500 | S | 5/2017 | Vanoncini et al. | |
| 2007/0110502 | A1 | 5/2007 | Salciarini et al. | |
| 2012/0312315 | A1 | 12/2012 | Gueret | |
| 2014/0371690 | A1 * | 12/2014 | Sprada | A61M 35/003 604/290 |
| 2016/0095415 | A1 | 4/2016 | Nakajima et al. | |

FOREIGN PATENT DOCUMENTS

| | | |
|---|---|---|
| EM | 001654781-0006 | 1/2010 |
| EP | 922405 | 10/2003 |
| EP | 1721543 | 11/2006 |
| FR | 2678494 | 1/1993 |
| JP | S6119539 U | 2/1986 |
| JP | 5059350 | 10/2012 |
| JP | 5641757 | 12/2014 |
| JP | D1569428 | 2/2017 |
| WO | WO-2017-131375 | 8/2017 |

OTHER PUBLICATIONS

PCT Written Opinion Of the International Searching Authority; International Application No. PCT/US2018/051102; Completion Date: Jan. 10, 2019; dated Jan. 10, 2019.

* cited by examiner

CAP AND VIAL APPLICATOR SYSTEM FOR APPLYING TWO COSMETIC PRODUCTS

FIELD OF THE INVENTION

The present invention relates to a cap and vial type applicator system including a wand and applicator depending from the cap. In particular, the present invention is directed to a cap and vial system with a wand applicator depending from the cap for dipping in a first cosmetic product in a vial. The cap includes a cartridge reservoir containing a second cosmetic product that can be dispensed through the wand. The first cosmetic product and the second cosmetic product may be applied separately or simultaneously using the wand.

DESCRIPTION OF THE PRIOR ART

Certain cosmetic 'looks' are achieved by applying more than one shade or color to the same application area. For example, lips can be made to look fuller and plumper by apply a first shade to the outer portions of the lips and a second shade to the inner portions of the lips (the "hombre" look).

A prior art device, the Etude House Twinshot Lipstint, includes a vial adapted to store a first cosmetic substance, a wand with an applicator and a cap with a fixed reservoir for a second cosmetic substance (not a cartridge). A click mechanism with an elevator system pushes product from the reservoir through the wand to the applicator. The click mechanism has a number of parts and is relatively more expensive. The mechanism with a fixed reservoir is also more difficult to assemble and fill. The second cosmetic substance is not easily selectable or changeable (e.g., a user cannot swap in a different color choice).

Accordingly, there is a need for a two color vial and wand reservoir system that is cost effective to assemble and fill, and that allows a user the flexibility to exchange colors.

BRIEF SUMMARY OF THE INVENTION

It is an object of the invention to provide a single package for storing two cosmetic substances.

It is a further object of the invention to provide a single package for storing two cosmetic substance and providing a single wand applicator for applying both substances either individually or together.

It is a further object of the invention to provide a single package for storing and dispensing two cosmetic substances with a single hollow wand, wherein one of the substances is stored in and delivered from a conventional vial and the other cosmetic substance is stored in and delivered from a cartridge reservoir in a cap portion of the applicator wand.

To overcome the problems of the prior art and achieve the objects of the invention, a cosmetic package with a cap and vial is provided with two product reservoirs, a first reservoir in a conventional vial and a second cartridge reservoir in the cap/handle of the wand. A conventional applicator may be secured on a distal end of the wand. The wand can be used to dip product from the vial and/or dispense product from the cartridge reservoir by way of a pump in the handle that dispenses from the cartridge reservoir through the hollow wand and a dispensing port in the applicator.

The advantages of the invention include simplified manufacture as well as convenience, flexibility and ease of use for the user.

DETAILED DESCRIPTION OF THE INVENTION

Figure 1:
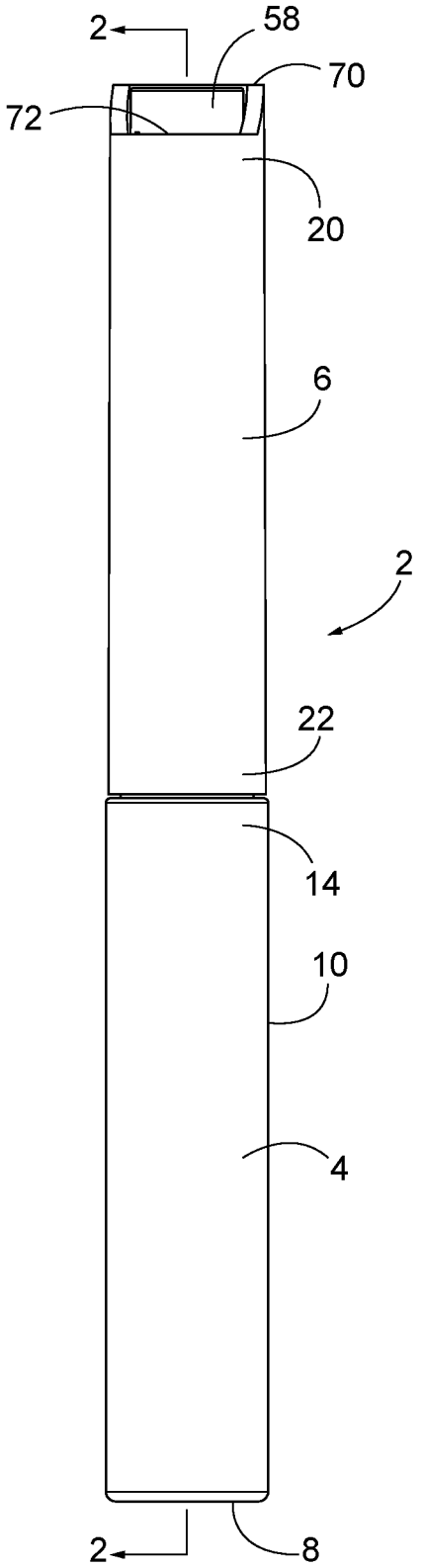
FIG. 1 is a front elevation view of the closed cap and vial applicator system of the invention.
Figure 2:
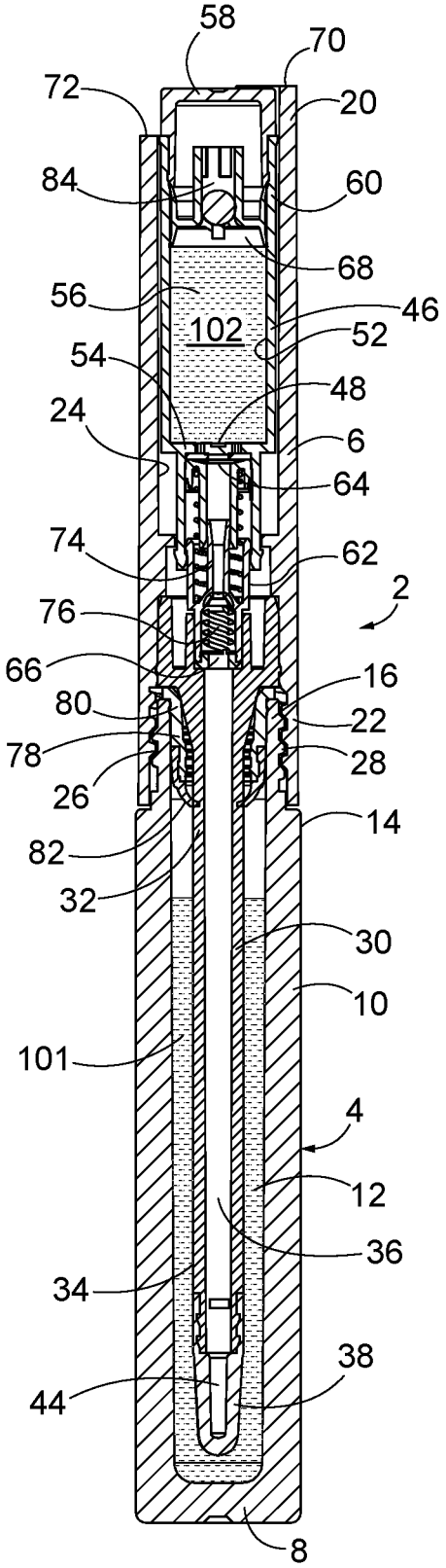
FIG. 2 is a cross-sectional elevation view of the cap and vial applicator system taken along sectional line 2-2 in FIG. 1.
Figure 3:
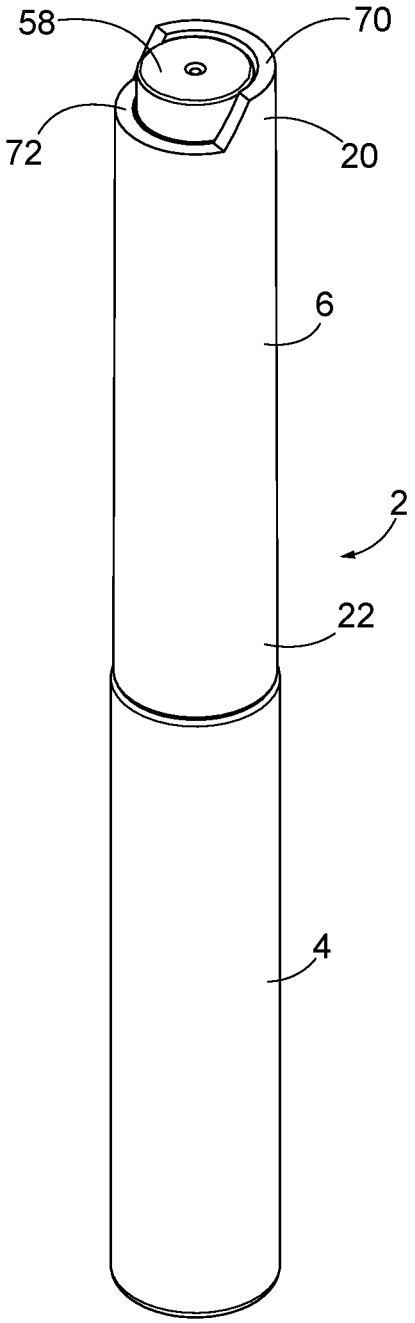
FIG. 3 is a top, front and right side perspective view of the cap and vial applicator system.
Figure 4:
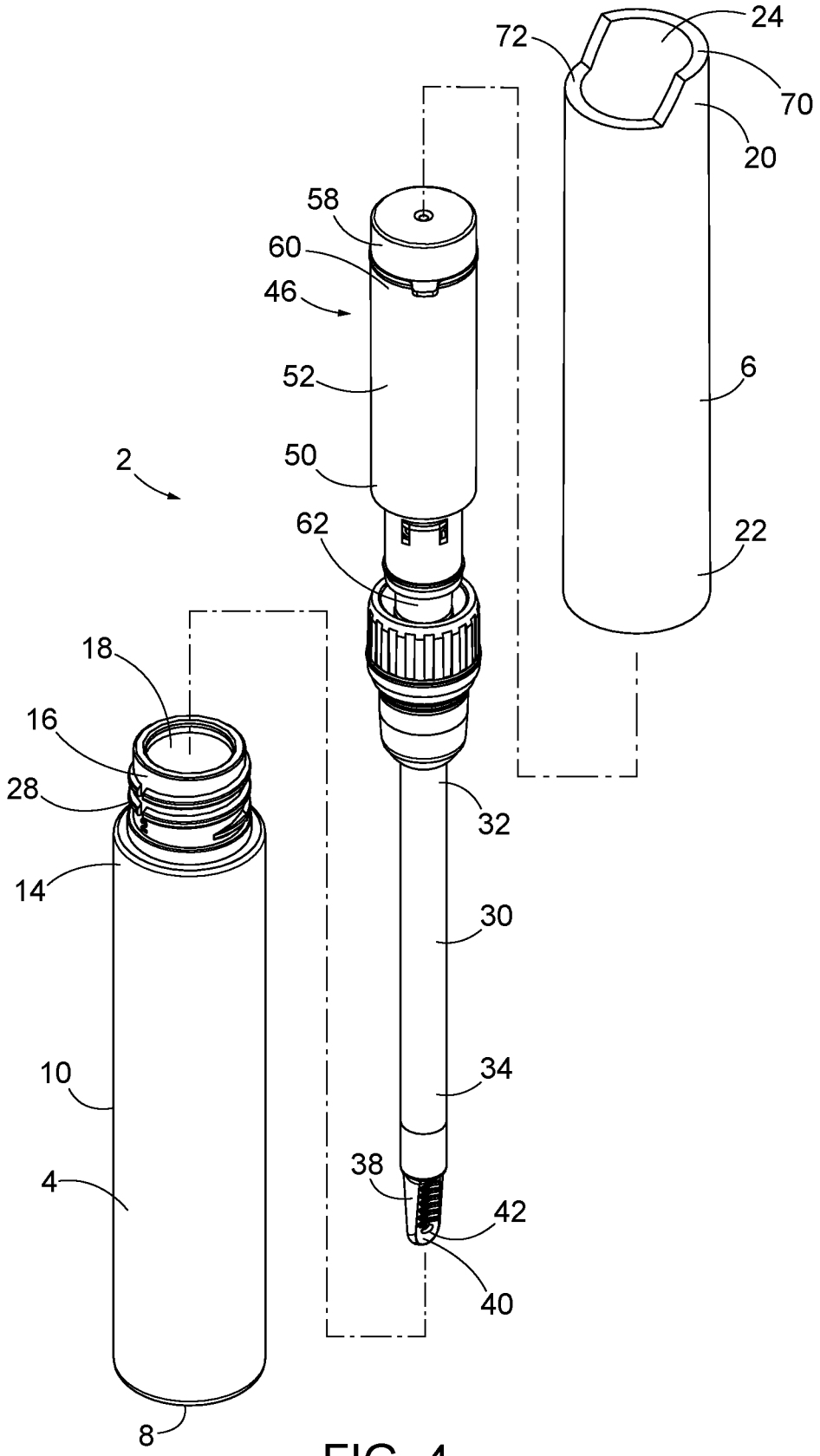
FIG. 4 is an exploded view of the various subcomponents of the cap and vial applicator system shown in FIG. 1.

Referring now to FIGS. 1-3, the applicator system for containing and dispensing a cosmetic first substance 101 and a cosmetic second substance 102 is shown generally at reference number 2. The system 2 includes a vial 4. As best seen in FIG. 2, the vial 4 has a bottom wall 8, a circumferential sidewall 10 extending upwardly from the bottom wall 8. The bottom wall 8 and sidewall 10 define a reservoir 12 for storing the cosmetic first substance 101. The sidewall 10 terminates at an upper end 14 in a neck 16 defining an opening 18 into the reservoir 12.

A cap 6 is provided on the vial 4. The cap 6 has a top end 20 and a bottom end 22. The top end 20 terminates in a top rim 70. The cap 6 at the top end 20 defines an upwardly opening cavity 24. The top rim 70 may be provided with a level circumferential height, or preferably, as illustrated, may have a stepped circumferential height with a recess 72 along the circumferential height defined by the top rim 70. The bottom end 22 of the cap 6 is adapted to be received on and engage the neck 16 of the vial 4 by, for example, having inwardly directed threads 26 for engaging outwardly directed threads 28 on the neck 16. Alternatively, the bottom end 22 of the cap 6 may be secured to the neck 16 of the vial 4 by, for example, a bayonet, a friction fit or other suitable engagement means. An elongated tubular rod 30 is secured to and depends downwardly from the bottom end 22 of the cap 6. The rod 30 has a proximal end 32 adjacent the bottom end 22 of the cap 6. The proximal end 32 of the rod 30 is secured to the bottom end 22 of the cap 6. The rod 30 extends downwardly away from the bottom end 22 of the cap 6 to a distal end 34. The rod 30 defines an interior channel 36 from the proximal end 32 to the distal end 34. An applicator 38 is secured to the distal end 34 of the rod 30 by adhering, welding, fusing, over molding, friction fitting, snap fitting or other suitable means. The applicator 38 defines an applicator surface 40 with at least one dispensing port 42. The applicator 38 has a delivery channel 44 providing fluid communication between the interior channel 36 at the distal end 34 of the rod 30 and the at least one dispensing port 42 in the applicator surface 40. The rod 30 is dimensioned to extend through the opening 18 in the neck 16 into the reservoir 12 such that the applicator surface 40 can retrieve a quantity of the cosmetic first substance 101 from within the vial reservoir 12. The cap 6 and rod 30 may be integrally formed from a single material as a single piece, or, as shown, may be formed as separate pieces from the same or different materials. When formed separately, the cap 6 and rod 30 may be secured to one another by adhering, welding, fusing, friction fitting or other suitable means for securing.

A removable cartridge 46 is provided in the cap 6 for storing the cosmetic second substance 102. The cartridge 46 has a vertically oriented tubular body 52 with a transverse wall 54 at a lower end 50. A plug 58 closes the top 60 of the tubular body 52. A storage chamber 56 is defined within the tubular body 52 between the plug 58 and the transverse wall 54. A quantity of the cosmetic second substance 102 is provided in the storage chamber 56. A piston-like follower 68 is provided above the quantity of second cosmetic substance to create an airtight seal at the upper end of the storage chamber 56. The follower 68 travels downwardly as the quantity of the second cosmetic substance 102 diminishes over time with use to minimize exposure of the second cosmetic substance 102 to air in the storage chamber 56. An evacuation port 48 is provided in the transverse wall 54. The cartridge 46 is adapted and dimensioned to be closely received in the cavity 24 in the cap 6 such that the cartridge 46 is vertically movable relative to the cap 6, and such that plug 58 is accessible at or extends above at least a portion of the top rim 70 of the cap 6. Evacuation port 48 is directed toward the interior channel 36 at the proximal end 32 of the rod 30. The cartridge 46 may be provided with a filling port 84 under the plug 58 in the follower 68 at the top 60 for loading the cosmetic second substance 102 into the storage chamber 56 of the cartridge 46.

A metering pump 62 having an inlet port 64 and an outlet port 66 is secured between the lower end 50 of the cartridge 46 and the proximal end 32 of the rod 30 such that the inlet port 64 of the pump 62 is in fluid communication with the evacuation port 48 of the cartridge and outlet port 66 of the pump 62 is in fluid communication with the interior channel 36 of the rod 30 at the proximal end 32 of the rod 30. When the plug 58 is pushed downwardly, the cartridge 46 is moved relative to the cap 6 into the cavity 24 which in turn activates the pump 62. When the pump 62 is activated, a metered amount of the second substance 102 is drawn from the evacuation port 48 of the cartridge 46 through the inlet port 64 of the pump 62. The metered amount flows from the outlet port 66 of the pump 62 through the interior channel 36 of the rod 30, the delivery channel 44 of the applicator 38 and out through the dispensing port 42 to the application surface 40.

The clearance 72 in the top rim 70 of the cap 6 facilitates access to the plug 58 and the cartridge 46 so that the cartridge 46 may be pushed down into the cap 6 to activate the pump 62.

As noted above, the cap 6 may be selectively secured to the vial 4 by cooperating screw threads, a bayonet, snap-fit, friction fit or other securing means. Overall packaging diameter dimension can range from 0.5 inches to 3.5 inches.

The applicator system holds two different liquid formulas, the cosmetic first substance 101 in the reservoir 12 in the vial 4 and the cosmetic second substance 102 in the storage chamber 56 in the cartridge 46 in the cap 6. To dispense the first cosmetic substance 101 from the system 2, the user grasps the cap 6, disengages it from the vial 4 and withdraws the rod 30 from the vial 4. A quantity of the first cosmetic substance 101 will be adhered to the applicator 38. The user applies the applicator surface 40 of applicator 38 to the desired area of skin to transfer at least some of the quantity of the first cosmetic substance 101 onto the application area. To dispense the cosmetic second substance 102 from the system 2, with the cap 6 and applicator 38 removed from the vial 4, the user pushes down on the cartridge 46 by way of the plug 58 causing the metering pump 62 to be activated. Activating the pump allows the second cosmetic substance to flow down through the rod 30 and ultimately to the applicator 38. A quantity of the cosmetic substance 102 dispenses from the dispensing port 42 onto the applicator surface 40. The user applies the applicator surface 40 of applicator 38 to the desired area of skin to transfer at least some of the quantity of the second cosmetic substance 102 onto the application area.

By the foregoing methods, users may apply a first layer of product, the quantity of the first cosmetic substance 101, that is picked up from the vial 4 with the applicator 38 (illustrated as a doe foot applicator, but any suitable applicator shape or configuration can be used). Subsequently, the user may apply a second product, the second cosmetic substance 102, from the applicator 38 after the second cosmetic substance 102 has been dispensed down through the rod 30 from the cartridge 46 in the cap 6 by pushing down on the cartridge 6.

The first cosmetic substance 101 and the second cosmetic substance 102 may be a treatment product (e.g., for wrinkles, moisturizing, sunblock, pigmentation, etc.) or a color cosmetic product (e.g., foundation, lip gloss, eyeshadow, brow color, etc.). If the rod 30 is transparent or translucent, a user may see the second cosmetic substance 102 moving down through the clear rod 30 (a visual interaction), particularly if the second cosmetic substance 102 is a color cosmetic product. The cartridge 46 can be made to be easily replaceable, allowing consumers to pick and choose the cartridge 46 at the counter for customizing and personalizing their look. The system can also be sold as a fully assembled final product.

Having the second cosmetic substance 102 in the cap allows the user to meter an effect or 'look' to individual desires, creating and defining a look to match a mood and or an individual sense of style and fashion. The system offers a true DIY experience giving the user a creative tool to express individual taste. The system also allows for fast and easy application of two different colors in a gradation to, for example, achieve an "ombre" look. It can be used, for example, in the lip category as introducing two different color combinations or as having lip color and treatment/oil together or as having lip color and lip finish top coat together (gloss, sparkle, matte, etc.). Similarly, the system can be used in the eye category for liquid eye shadow or cream eye shadow. The system can also be utilized as a treatment product by carrying 2 different treatment substances that are unstable when combined in the same mass for a long time. Combining the two substances immediately prior to application yields instant activation. The system can also combine, for example, a skincare product and a color product shade that acts as a concealer to cover up blemishes.

As noted above, the second cosmetic substance 102 is in the cartridge 46 which is inserted into the cap 6. The substance 102 flows down through the applicator rod 30 when the pump 62 is activated. The cartridge 46 may be filled separately, and subsequently assembled into the cap 6. This may reduce assembly and filling steps and minimizes the scrap rate for an entire system (only the cartridge is scrapped if a filling error occurs). Alternatively, the cartridge 46 may be assembled into the cap 6 and subsequently filled with cosmetic substance 102.

The cartridge 46 acts like a button in the cap 6 to activate the pump 62. Pushing on the cartridge 46 activates the pump 62 to dispense an amount of the cosmetic substance 102 through the applicator 38. When the cartridge 46 is pressed down into the cap 6, it springs back up to a rest position under pressure from one or more return springs 74, 76 in the pump. The pump 62 dispenses a metered amount of cosmetic substance 102 from the cartridge 46 as a result of a single push on the cartridge 46.

The applicator 38 is preferably made from a resilient material, such as, for example, a silicon or TPE (thermoplastic elastomer) material. A silicon/TPE material is preferred for at least the following reasons. First, a silicone/TPE will not load excess product (cosmetic substance 101 or 102) on the applicator as opposed to a flocked applicator, sponge applicator or any porous material that would load excess cosmetic substance. This is critical to avoid or minimize contamination of the first cosmetic substance 101 in the vial with excess amounts of the second cosmetic substance 102 from the applicator surface 40. Second, a silicone/TPE material is more hygienic as the surface area is non-porous.

To further avoid or minimize contamination of the cosmetic first substance 101 by the cosmetic second substance 102, or vice versa, the dispensing port 42 in the applicator 38 can be provided as a valve-like cut or slit instead of a larger opening. The cut or slit dispensing port 42 will open when the cosmetic second substance 102 is under dispensing pressure from the pump, and the cut or slit dispensing port 42 will close off automatically due to the resilient nature of the applicator material after releasing the cosmetic second substance 102 and cessation of the dispensing pressure from the pump.

A wiper 78 is provided in the opening 18 in the neck 16 of the vial 4 to wipe excess cosmetic substance from the rod 30. If the rod 30 is made from a clear material, preferably the wiper 78 is provided such that the rod 30 is completely stripped of excess cosmetic substance so that a user can see the clear rod and the dispensing of the cosmetic second substance 102 through the clear rod 30. Preferably, the wiper has an upper portion or neck 80 made of a relatively rigid material, and a lower portion or throat 82 with a tight orifice made of a very soft material such as, for example, silicon/TPE material. The throat 82 is adapted to let the applicator 38 go through the wiper 78 with low or no stress to the applicator 38. The throat 82 deforms and stretches to accommodate the shape of the applicator rod 30 and the applicator 38 while wiping all excess cosmetic substance from the rod 30.

As noted above, at least one advantage of providing two different cosmetic substances in a single package system is that it offers consumers the option of using one of the two cosmetic substances, either cosmetic first substance 101 or cosmetic second substance 102, alone, or to mix the two products in an easy way. The system allows the consumer to use one applicator to apply two different cosmetic substances either alone or in combination to create a new look, with a simple gesture of clicking the cartridge in the cap. The cartridge in the cap is easy to assemble, it can also be sold individually for consumers to customize the system.

The application system can be utilized in the lip category to, for example, introduce two different color combinations or to have lip color and treatment/oil together in one package, or to have lip color and lip finish top coat (e.g., a gloss, sparkle, matte, etc.) together in one package. The application system can be utilized in the eye category for, for example, liquid eye shadow or cream eye shadow. The application system can also be utilized to dispense and apply a treatment product by carrying separately two different treatment products that would be unstable in combination in same mass if stored for a long time. By mixing just prior to application (instant activation), the instability issue is avoided. The application system can also be utilized to dispense and apply skincare product and a color product shade that acts as a concealer to cover up blemishes. The application system can also be utilized to dispense and apply brow makeup, mascara or hair treatment or color products. For example, a color cosmetic substance may be stored in the vial and a top coat or root treatment product can be stored in the cartridge in the cap. The combinations possible are varied and numerous.

Preferably, the applicator 38 is made from a silicone or other resilient material, or any suitable material for making applicators. The applicator 38 can also be rigid. If the applicator 38 is rigid, it will preferably be textured to facilitate pick up and loading of cosmetic substances. Alternatively, the applicator may take the form of a metal ball roller (not shown) at the tip to restrict the constant flow. The applicator may be made of more than one material, such as, for example, silicone body plus fiber flocking on surface, or a silicone body with a smooth rigid surface, etc.

It is understood that various modifications and changes in the specific form and construction of the various parts can be made without departing from the scope of the following claims.

What is claimed is:

1. An applicator system for containing and dispensing a cosmetic first substance and a cosmetic second substance, the second substance different from the first substance, the system comprising:

a vial having a bottom wall, a circumferential sidewall extending upwardly from the bottom wall, the bottom wall and sidewall defining a reservoir for storing the first substance, the sidewall terminating at an upper end in a neck defining an opening into the reservoir;

a cap with a top end and a bottom end, the top end defining an upwardly opening cavity, the bottom end of the cap adapted to be received on and engage the neck of the vial, an elongated tubular rod secured to and depending from the bottom end of the cap, the rod having a proximal end adjacent the bottom end of the cap, the rod extending to a distal end, the rod defining an interior channel from the proximal end to the distal end, an applicator secured to the distal end of the rod, the applicator defining an applicator surface with at least one dispensing port, the applicator having a delivery channel providing fluid communication between the interior channel at the distal end of the rod and the at least one dispensing port in the applicator surface, the rod dimensioned to extend through the opening in the neck into the reservoir such that the applicator surface can retrieve a quantity of the first substance from within the vial reservoir;

a cartridge for storing the second substance, the cartridge having an evacuation port at a lower end, the cartridge dimensioned to be received in the cavity such that the evacuation port is directed toward the interior channel at the proximal end of the rod; and a metering pump having an inlet port and an outlet port, the pump secured between the cartridge and the rod such that the inlet port of the pump is in fluid communication with the evacuation port of the cartridge and outlet port of the pump is in fluid communication with the interior channel at the proximal end of the rod, wherein the that pump can draw metered amounts of the second substance from the cartridge through the evacuation port and dispenses such metered quantities to the applicator surface through the at least one dispensing port via the interior channel of the rod and delivery channel of the applicator.

2. The cap and vial applicator system of claim 1 wherein the applicator is made from a resilient material and the dispensing port is a valve-like slit or cut that opens when the second substance is dispensed under pressure from the pump, and closes when the second substance is no longer under dispensing pressure from the pump.

3. The cap and vial applicator system of claim 1 wherein the rod is made from a clear material.

4. The cap and vial applicator system of claim 1 further comprising a wiper secured in the opening in the neck of the vial, the wiper adapted to wipe excess cosmetic substances from the rod and applicator, the wiper having an upper portion made of a relatively rigid material and a lower portion made from a resilient material.

* * * * *